US010012081B2

(12) United States Patent
Kemp et al.

(10) Patent No.: US 10,012,081 B2
(45) Date of Patent: Jul. 3, 2018

(54) MULTI-VANE IMPELLER DEVICE

(71) Applicant: TORAD Engineering LLC, Cumming, GA (US)

(72) Inventors: Gregory T. Kemp, Alpharetta, GA (US); Joseph S. Orosz, Woodtsock, GA (US); John L. Montgomery, Lilburn, GA (US)

(73) Assignee: Torad Engineering LLC, Cumming, GA (US)

( * ) Notice: Subject to any disclaimer, the term of this patent is extended or adjusted under 35 U.S.C. 154(b) by 144 days.

(21) Appl. No.: 15/264,823

(22) Filed: Sep. 14, 2016

(65) Prior Publication Data

US 2017/0074099 A1 Mar. 16, 2017

Related U.S. Application Data

(60) Provisional application No. 62/218,254, filed on Sep. 14, 2015.

(51) Int. Cl.
*F03C 4/00* (2006.01)
*F04C 2/00* (2006.01)
(Continued)

(52) U.S. Cl.
CPC ..... *F01C 1/321* (2013.01); *F01C 19/02* (2013.01); *F01C 21/008* (2013.01); *F01C 21/04* (2013.01);
(Continued)

(58) Field of Classification Search
CPC .. F04C 2/321; F04C 15/0088; F04C 15/0065; F04C 18/321; F04C 29/02;
(Continued)

(56) References Cited

U.S. PATENT DOCUMENTS 984,061 A 2/1911 Augustine
1,923,291 A 8/1933 Zimmerer
(Continued)

FOREIGN PATENT DOCUMENTS

CN 101918675 A 12/2010
CN 104271960 A 1/2015
(Continued)

OTHER PUBLICATIONS

Copenheaver, Blaine R.; International Search Report from counterpart International Patent Application No. PCT/US2016/050648; pp. 1-2, dated Nov. 10, 2016, United States Patent and Trademark Office as International Search Authority, Alexandria, Virginia USA.
(Continued)

*Primary Examiner* — Theresa Trieu
(74) *Attorney, Agent, or Firm* — Ballard Spahr LLP

(57) ABSTRACT

A device usable as an impeller has a plurality of vanes rotating eccentrically about a shaft. Eccentric rotation is enabled by a cam mounted on the shaft. The vanes are received within slots in a rotor which surrounds the shaft and rotates about an axis coaxial with the shaft. The rotor rotates within a housing having a cylindrical surface facing the rotor. The surface is eccentric to the shaft. The vanes execute reciprocal motion upon rotation of the rotor. The vane motion is constrained so that the edges of the vanes remain proximate to the cylindrical surface during rotation.

38 Claims, 7 Drawing Sheets

(51) Int. Cl.

| | |
|---|---|
| ***F04C 18/00*** | (2006.01) |
| ***F01C 1/32*** | (2006.01) |
| ***F04C 2/32*** | (2006.01) |
| ***F04C 15/00*** | (2006.01) |
| ***F04C 18/32*** | (2006.01) |
| ***F04C 29/02*** | (2006.01) |
| ***F04C 29/00*** | (2006.01) |
| ***F01C 19/02*** | (2006.01) |
| ***F01C 21/00*** | (2006.01) |
| ***F01C 21/04*** | (2006.01) |
| ***F01C 21/08*** | (2006.01) |
| ***F01C 21/10*** | (2006.01) |

(52) U.S. Cl.
CPC ..... *F01C 21/0809* (2013.01); *F01C 21/10* (2013.01); *F04C 2/321* (2013.01); *F04C 15/0065* (2013.01); *F04C 15/0088* (2013.01); *F04C 18/321* (2013.01); *F04C 29/0057* (2013.01); *F04C 29/02* (2013.01)

(58) Field of Classification Search
CPC ..... F04C 29/0057; F01C 1/321; F01C 19/02; F01C 21/008; F01C 21/04; F01C 21/0809; F01C 21/10
USPC ..... 418/259–260, 262
See application file for complete search history.

(56) References Cited

U.S. PATENT DOCUMENTS

| | | | |
|---|---|---|---|
| 1,964,492 | A | 6/1934 | Yandell |
| 2,057,381 | A | 10/1936 | Kenney et al. |
| 2,246,271 | A | 6/1941 | Davidson |
| 2,590,728 | A | 3/1952 | Scognamillo |
| 2,800,274 | A | 7/1957 | Makaroff et al. |
| 3,134,600 | A | 5/1964 | Fisch |
| 3,213,803 | A | 10/1965 | Meyer |
| 3,256,831 | A | 6/1966 | Eickmann |
| 3,269,646 | A | 8/1966 | August |
| 3,294,454 | A | 12/1966 | Foerster et al. |
| 3,357,412 | A | 12/1967 | Sabet |
| 3,596,641 | A | 8/1971 | Hofmann |
| 3,769,944 | A | 11/1973 | Raymond |
| 3,799,035 | A | 3/1974 | Lamm |
| 3,832,105 | A | 8/1974 | Takahashi |
| 3,841,802 | A | 10/1974 | Van Grecken |
| 3,869,775 | A | 3/1975 | Smith |
| 3,904,327 | A | 9/1975 | Edwards et al. |
| 3,988,083 | A | 10/1976 | Shimizu et al. |
| 4,137,018 | A | 1/1979 | Brucken |
| 4,144,005 | A | 3/1979 | Brucken |
| 4,149,833 | A | 4/1979 | Baudin |
| 4,299,546 | A | 11/1981 | Stout |
| 4,330,240 | A | 5/1982 | Eslinger |
| 4,331,421 | A | 5/1982 | Jones et al. |
| 4,410,305 | A | 10/1983 | Shank et al. |
| 4,411,190 | A | 10/1983 | Kilmer |
| 4,415,320 | A | 11/1983 | Maruyama et al. |
| 4,432,711 | A | 2/1984 | Tsuchiya et al. |
| 4,435,138 | A | 3/1984 | Johnson |
| 4,439,117 | A | 3/1984 | Bunger |
| 4,465,445 | A | 8/1984 | Sommer |
| 4,484,873 | A | 11/1984 | Inagaki et al. |
| 4,487,029 | A | 12/1984 | Hidaka et al. |
| 4,502,850 | A | 3/1985 | Inagaki et al. |
| 4,507,067 | A | 3/1985 | Hansen |
| 4,537,162 | A | 8/1985 | Kienle |
| 4,560,328 | A | 12/1985 | Kayser |
| 4,607,820 | A | 8/1986 | Nissen |
| 4,781,551 | A | 11/1988 | Tanaka |
| 4,901,694 | A | 2/1990 | Sakita |
| 4,927,342 | A | 5/1990 | Kim et al. |
| 4,929,161 | A | 5/1990 | Aoki et al. |
| 4,955,985 | A | 9/1990 | Sakamaki et al. |
| 4,958,992 | A | 9/1990 | Winiger |
| 4,975,034 | A | 12/1990 | Ellis |
| 4,997,353 | A | 3/1991 | Sakamaki et al. |
| 4,998,868 | A | 3/1991 | Sakamaki et al. |
| 5,002,473 | A | 3/1991 | Sakamaki et al. |
| 5,011,390 | A | 4/1991 | Sakamaki et al. |
| 5,022,842 | A | 6/1991 | Sakamari et al. |
| 5,044,910 | A | 9/1991 | Sakamari et al. |
| 5,087,183 | A | 2/1992 | Edwards |
| 5,135,368 | A | 8/1992 | Amin et al. |
| 5,160,252 | A | 11/1992 | Edwards |
| 5,181,843 | A | 1/1993 | Hekman et al. |
| 5,224,850 | A | 7/1993 | Koh |
| 5,322,424 | A | 6/1994 | Fujio |
| 5,374,171 | A | 12/1994 | Cooksey |
| 5,374,172 | A | 12/1994 | Edwards |
| 5,383,774 | A | 1/1995 | Toyama et al. |
| 5,391,067 | A | 2/1995 | Saunders |
| 5,415,141 | A | 5/1995 | McCann |
| 5,417,555 | A | 5/1995 | Kuban et al. |
| 5,439,358 | A | 8/1995 | Weinbrecht |
| 5,443,376 | A | 8/1995 | Choi |
| 5,452,997 | A | 9/1995 | Heckman et al. |
| 5,452,998 | A | 9/1995 | Edwards |
| 5,472,327 | A | 12/1995 | Strikis et al. |
| 5,489,199 | A | 2/1996 | Palmer |
| 5,501,586 | A | 3/1996 | Edwards |
| 5,522,356 | A | 6/1996 | Palmer |
| 5,551,853 | A | 9/1996 | Cherry et al. |
| 5,564,916 | A | 10/1996 | Yammamoto et al. |
| 5,564,917 | A | 10/1996 | Leyderman et al. |
| 5,577,903 | A | 11/1996 | Yamamoto |
| 5,597,168 | A | 1/1997 | Antonini |
| 5,616,019 | A | 4/1997 | Hattori et al. |
| 5,660,540 | A | 8/1997 | Kang |
| 5,678,657 | A | 10/1997 | Lee |
| 5,694,682 | A | 12/1997 | Zuercher et al. |
| 5,697,773 | A | 12/1997 | Mendoza et al. |
| 5,713,732 | A | 2/1998 | Riney |
| 5,758,501 | A | 6/1998 | Jirnov et al. |
| 5,871,342 | A | 2/1999 | Harte et al. |
| 6,036,462 | A | 3/2000 | Mallen |
| 6,065,289 | A | 5/2000 | Phillips |
| 6,089,830 | A | 7/2000 | Harte et al. |
| 6,099,259 | A | 8/2000 | Monk et al. |
| 6,109,894 | A | 8/2000 | Chatelain |
| 6,120,273 | A | 9/2000 | Mallen |
| 6,226,986 | B1 | 5/2001 | Driver et al. |
| 6,231,468 | B1 | 5/2001 | Bajulaz |
| 6,241,496 | B1 | 6/2001 | Kim et al. |
| 6,296,462 | B1 | 10/2001 | Driver et al. |
| 6,336,800 | B1 | 1/2002 | Kim et al. |
| 6,354,262 | B2 | 3/2002 | Wade |
| 6,382,150 | B1 | 5/2002 | Fischer |
| 6,435,850 | B2 | 8/2002 | Sunaga et al. |
| 6,503,071 | B2 | 1/2003 | Edwards |
| 6,616,433 | B1 | 9/2003 | Simonds |
| 6,623,261 | B2 | 9/2003 | Edwards |
| 6,659,067 | B1 | 12/2003 | Al-Hawaj |
| 6,688,869 | B1 | 2/2004 | Simonds |
| 6,722,867 | B2 | 4/2004 | Murata |
| 6,732,542 | B2 | 5/2004 | Yamasaki et al. |
| 6,796,773 | B1 | 9/2004 | Choi et al. |
| 6,824,367 | B2 | 11/2004 | Matsumoto et al. |
| 6,905,322 | B1 * | 6/2005 | Simonds ..... F01C 21/0836 418/264 |
| 6,926,505 | B2 | 8/2005 | Sbarounis |
| 6,932,588 | B2 | 8/2005 | Choi et al. |
| 7,059,843 | B1 | 6/2006 | Badgley |
| 7,134,846 | B2 | 11/2006 | Djordjevic |
| 7,174,725 | B2 | 2/2007 | Tadano et al. |
| 7,175,401 | B2 | 2/2007 | Cho et al. |
| 7,192,264 | B2 | 3/2007 | Viitamaki |
| 7,217,110 | B2 | 5/2007 | Dreiman |
| 7,231,894 | B2 | 6/2007 | Driver |
| 7,344,367 | B2 | 3/2008 | Manole |
| 7,845,922 | B2 | 12/2010 | Langenbach et al. |
| 8,113,805 | B2 | 2/2012 | Kemp |

(56) References Cited

U.S. PATENT DOCUMENTS

| | | | | |
|---|---|---|---|---|
| 8,177,536 | B2 | 5/2012 | Kemp | |
| 8,561,316 | B2 | 10/2013 | Yamamuro et al. | |
| 8,807,975 | B2 | 8/2014 | Kemp | |
| 9,441,629 | B2 | 9/2016 | Kemp | |
| 2003/0021713 | A1 | 1/2003 | Edwards | |
| 2004/0009083 | A1 | 1/2004 | Kim et al. | |
| 2004/0071576 | A1 | 4/2004 | Matsumoto et al. | |
| 2004/0005235 | A1 | 6/2004 | Didin | |
| 2004/0118375 | A1 | 6/2004 | Beaudoin | |
| 2005/0180874 | A1 | 8/2005 | Wells | |
| 2005/0232801 | A1* | 10/2005 | Viitamaki | F01C 21/0836 418/261 |
| 2005/0260091 | A1 | 11/2005 | Staffend | |
| 2006/0140802 | A1 | 6/2006 | Ogasawara et al. | |
| 2006/0182646 | A1 | 8/2006 | Sato | |
| 2006/0196464 | A1 | 9/2006 | Conners | |
| 2006/0198749 | A1 | 9/2006 | Hwang et al. | |
| 2006/0210418 | A1 | 9/2006 | Bae et al. | |
| 2006/0257278 | A1 | 11/2006 | Zak | |
| 2007/0003423 | A1 | 1/2007 | Lee | |
| 2007/0003425 | A1 | 1/2007 | Masuda | |
| 2007/0031276 | A1 | 2/2007 | Masuda | |
| 2007/0031277 | A1 | 2/2007 | Edwards | |
| 2007/0041860 | A1 | 2/2007 | Nakamoto et al. | |
| 2007/0044751 | A1 | 3/2007 | Guan et al. | |
| 2007/0065324 | A1 | 3/2007 | Masuda | |
| 2007/0065326 | A1 | 3/2007 | Orsello | |
| 2007/0154328 | A1 | 7/2007 | Bae et al. | |
| 2007/0280843 | A1 | 12/2007 | Bae et al. | |
| 2008/0031756 | A1 | 2/2008 | Hwang et al. | |
| 2009/0081063 | A1 | 3/2009 | Kemp | |
| 2011/0120414 | A1 | 5/2011 | Quantz | |
| 2012/0031368 | A1* | 2/2012 | Sleiman | F01C 21/0836 418/264 |
| 2013/0078127 | A1 | 3/2013 | Pawellek | |
| 2016/0040666 | A1 | 2/2016 | Kemp et al. | |

FOREIGN PATENT DOCUMENTS

| | | | | |
|---|---|---|---|---|
| DE | 1811439 | | 11/1968 | |
| DE | 3611395 | A1 | 10/1987 | |
| EP | 0325694 | A2 | 8/1989 | |
| GB | 324414 | | 5/1929 | |
| JP | 56-044489 | | 4/1981 | |
| JP | 2010540826 | A | 12/2010 | |
| WO | 9213176 | | 8/1992 | |
| WO | 9904141 | | 1/1999 | |
| WO | 9961752 | A1 | 12/1999 | |
| WO | 0049295 | | 8/2000 | |
| WO | WO 2014113491 | A2 * | 7/2014 | F01C 21/0836 |

OTHER PUBLICATIONS

Copenheaver, Blaine R.; Written Opinion of the International Searching Authority, from counterpart International Patent Application No. PCT/US2016/050648; pp. 1-4, dated Nov. 10, 2016, United States Patent and Trademark Office as International Search Authority, Alexandria, Virginia USA.

* cited by examiner

MULTI-VANE IMPELLER DEVICE

CROSS REFERENCE TO RELATED APPLICATION

This application is based upon and claims the benefit of priority to U.S. Provisional Application No. 62/218,254, filed Sep. 14, 2015 and hereby incorporated by reference.

FIELD OF THE INVENTION

This invention relates to impeller mechanisms usable with machines such as engines, pumps, compressors and hydraulic motors.

BACKGROUND

Impellers, specifically traditional non-constrained vane machines involving reciprocating vanes according to the prior art suffer various disadvantages. In such machines the vane or vanes ride in a slot and are pushed outwardly via centrifugal force, fluid pressure, springs or a combination of these elements such that the vanes ride in direct contact with the bore of the machine. The efficiency of this class of vane machines, when used in a pump or a compressor for example, tends to be low due to friction, which also causes accelerated wear, thereby shortening machine life. Another class of vane machines, known as constrained vane machines, have mechanisms which control the motion of the vanes and prohibit them from running in direct contact with the bore of the machine. This reduces the aforementioned friction associated with non-constrained machines and consequently decreases wear and increases efficiency. However, the design of such machines is often complicated, with many moving parts, which limits the speed at which such impellers may run safely. Machine cost and reliability may also be adversely affected. There is a clear demand for improved impeller designs which do not suffer the manifest disadvantages of prior art devices.

SUMMARY

The invention concerns impeller devices. In an example embodiment a device comprises a shaft defining a shaft axis. A cam is mounted on the shaft. The cam has a lobe projecting eccentric to the shaft axis. A plurality of projections are rotatably mounted on the cam. Each of the projections is pivotably mounted relative to the cam. A rotor surrounds the cam and is rotatable relatively thereto about the shaft axis. The rotor comprises a plurality of openings. Each of the openings receives one of the projections. Rotation of the rotor relatively to the cam causes the projections to rotate about the shaft axis while also reciprocating within the openings radially toward and away from the shaft axis.

In one example a plurality of rings surrounds the cam. Each one of the projections are pivotably attached to a respective one of the rings. The rings are rotatable relatively to the cam. Further by way of example, each ring comprises a ring lug extending therefrom. Each ring lug receives a respective pin having a pin axis oriented parallel to the shaft axis. Each projection comprises a projection lug extending therefrom. Each projection lug receives a respective one of the pins. Each of the projections is pivotable relative to one of the rings about one of the pin axes.

An example device further comprises a bearing mounted in the rotor concentric to the shaft. The bearing supports an end of the shaft proximate to the cam. A housing surrounds the rotor. The rotor extends from one end of the housing. The shaft is mounted on an opposite end of the housing. The rotor is rotatable relatively to the housing. By way of example the housing comprises a cylindrical surface facing the rotor. The cylindrical surface is coaxial with a housing axis and the housing axis is offset from the shaft axis. In a specific example embodiment the housing axis is offset from the shaft axis in a direction in which the lobe projects. Further by way of example the lobe is angularly positioned about the shaft with respect to the cylindrical surface so as to maintain an end of each the projection proximate to the cylindrical surface during reciprocal motion of the projections upon relative rotation between the rotor and the shaft.

An example embodiment further comprises first and second apertures in the housing. The apertures are oriented transversely to the shaft axis and angularly offset from one another about the cylinder axis. In an example embodiment a first bearing is positioned at the one end of the housing between the rotor and the housing, and a second bearing is positioned at the opposite end of the housing between the rotor and the housing. In an example embodiment each one of the projections comprises a vane having first and second oppositely arranged surfaces oriented parallel to the shaft axis. Further by way of example, each one of the openings comprises a slot, and each one of the slots receives a respective one of the vanes.

An example embodiment further comprises first and second apertures in the housing. The apertures are oriented transversely to the shaft axis and extend through the cylindrical surface. The apertures are angularly offset from one another about the cylinder axis. In a specific example embodiment the device comprises four of the vanes. In a further example each vane is oriented perpendicularly to an adjacent one of the vanes. By way of example the lobe is angularly positioned about the shaft with respect to the cylindrical surface so as to maintain an edge of each the vane proximate to the cylindrical surface during reciprocal motion of the projections upon relative rotation between the rotor and the shaft.

In an example embodiment each of the vanes comprises a respective seal extending along the edge. The seals contact the cylindrical surface continuously upon relative rotation between the rotor and the shaft. Another example embodiment comprises first and second end plates attached to the rotor in spaced relation to one another. The vanes are positioned between the end plates.

In a specific example the cam and the shaft are integrally formed. By way of example the rotor comprises a rotor body surrounding the cam. The openings are positioned in the rotor body. A rotor shaft is attached to one end of the rotor body and extends therefrom to define a rotor axis of rotation. A hub is attached to an opposite end of the rotor body. The hub is coaxially aligned with the rotor axis of rotation. In a specific example embodiment the openings comprise slots oriented parallel to the rotor axis of rotation.

The invention also comprises an example device, comprising a shaft defining a shaft axis. A cam is mounted on the shaft. The cam has a lobe projecting eccentric to the shaft axis. A plurality of vanes are rotatably mounted on the cam. Each vane is pivotably mounted relative to the cam. A rotor surrounds the cam and is rotatable relatively thereto about the shaft axis. The rotor comprises a plurality of slots. Each slot receives one of the vanes. Rotation of the rotor relatively to the cam causes the vanes to rotate about the shaft axis while also reciprocating within the slots radially toward and away from the shaft axis.

In the example embodiment each of the vanes has first and second oppositely arranged surfaces oriented parallel to the shaft axis. By way of example a plurality of rings surround the cam. Each vane is pivotably attached to a respective one of the rings. The rings are rotatable relatively to the cam.

In a specific example embodiment each ring comprises a ring lug extending therefrom. Each the ring lug receives a respective pin having a pin axis oriented parallel to the shaft axis. Each vane comprises a vane lug extending therefrom. Each vane lug receives a respective one of the pins. Each of the vanes is pivotable relative to one of the rings about one of the pin axes.

In a further example embodiment a bearing is mounted in the rotor concentric to the shaft. The bearing supports an end of the shaft proximate to the cam. An example embodiment further comprises a housing surrounding the rotor. The rotor extends from one end of the housing. The shaft is mounted on an opposite end of the housing. The rotor is rotatable relatively to the housing. By way of example the housing comprises a cylindrical surface facing the rotor. The cylindrical surface is coaxial with a housing axis. The housing axis is offset from the shaft axis. In a specific example embodiment the housing axis is offset from the shaft axis in a direction in which the lobe projects. Further by way of example the lobe is angularly oriented about the shaft with respect to the cylindrical surface so as to maintain an edge of each the vane proximate to the cylindrical surface during reciprocal motion of the vanes upon relative rotation between the rotor and the shaft.

In an example embodiment each of the vanes comprises a respective seal extending along the edge. The seals contact the cylindrical surface continuously upon relative rotation between the rotor and the shaft. Another example embodiment further comprises first and second apertures in the housing. The apertures are oriented transversely to the shaft axis and extend through the cylindrical surface. The apertures are angularly offset from one another about the cylinder axis.

An example embodiment of a device further comprises a first bearing positioned at the one end of the housing between the rotor and the housing. A second bearing is positioned at the opposite end of the housing between the rotor and the housing. A particular example embodiment comprises four of the vanes. By way of further example each vane is oriented perpendicularly to an adjacent one of the vanes. Again in an example embodiment, first and second end plates are attached to the rotor in spaced relation to one another. The vanes are positioned between the end plates.

In a specific example embodiment the cam and the shaft are integrally formed. Further by way of example the rotor comprises a rotor body surrounding the cam. The slots are positioned in the rotor body. A rotor shaft is attached to one end the rotor body and extends therefrom to define a rotor axis of rotation. A hub is attached to an opposite end of the rotor body. The hub is coaxially aligned with the rotor axis of rotation. By way of example the slots are oriented parallel to the rotor axis of rotation.

DETAILED DESCRIPTION

Figure 1:
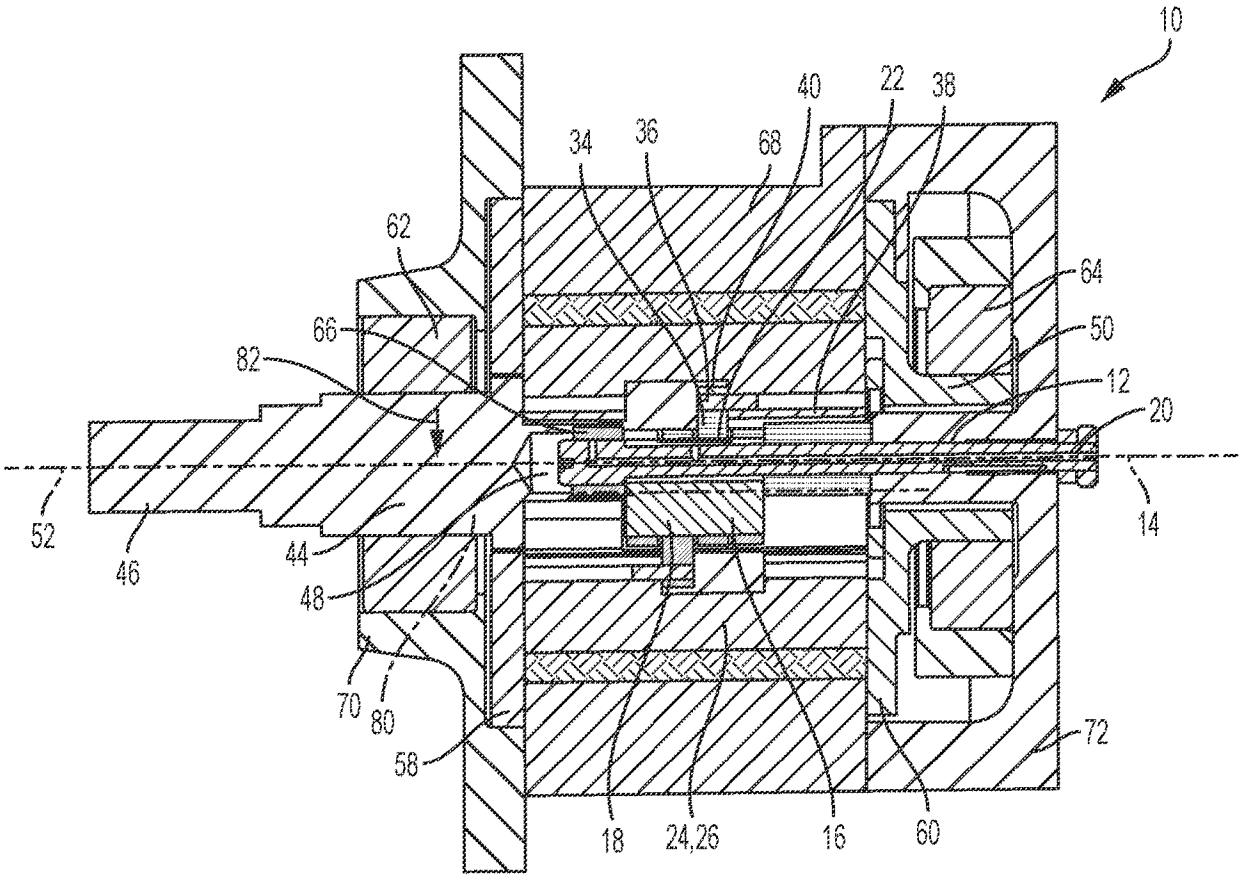
FIGS. 1 and 1A are longitudinal sectional views of example embodiments of devices according to the invention.
Figure 2:
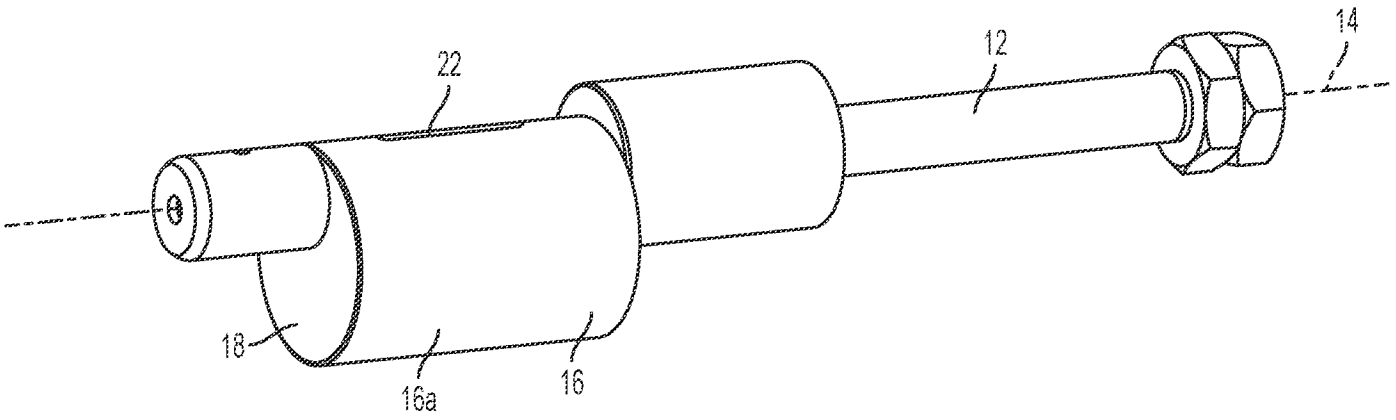
FIG. 2 is an isometric view of a component used in the devices shown in FIGS. 1 and 1A.

FIG. 1 is a longitudinal sectional view of an example device 10 according to the invention. As shown in FIGS. 1 and 2, example device 10 comprises a shaft 12 defining a shaft axis 14. A cam 16 is mounted on shaft 12. Cam 16 has a lobe 18 which projects eccentric to the shaft axis 12. Shaft 12 and cam 16 may be integrally formed, for an example, from a machined forging. Shaft 12 may further have a bore 20 in fluid communication with a duct 22 in cam 16 to provide lubricating oil to the outer surface 16*a* of cam 16.

Figure 3:
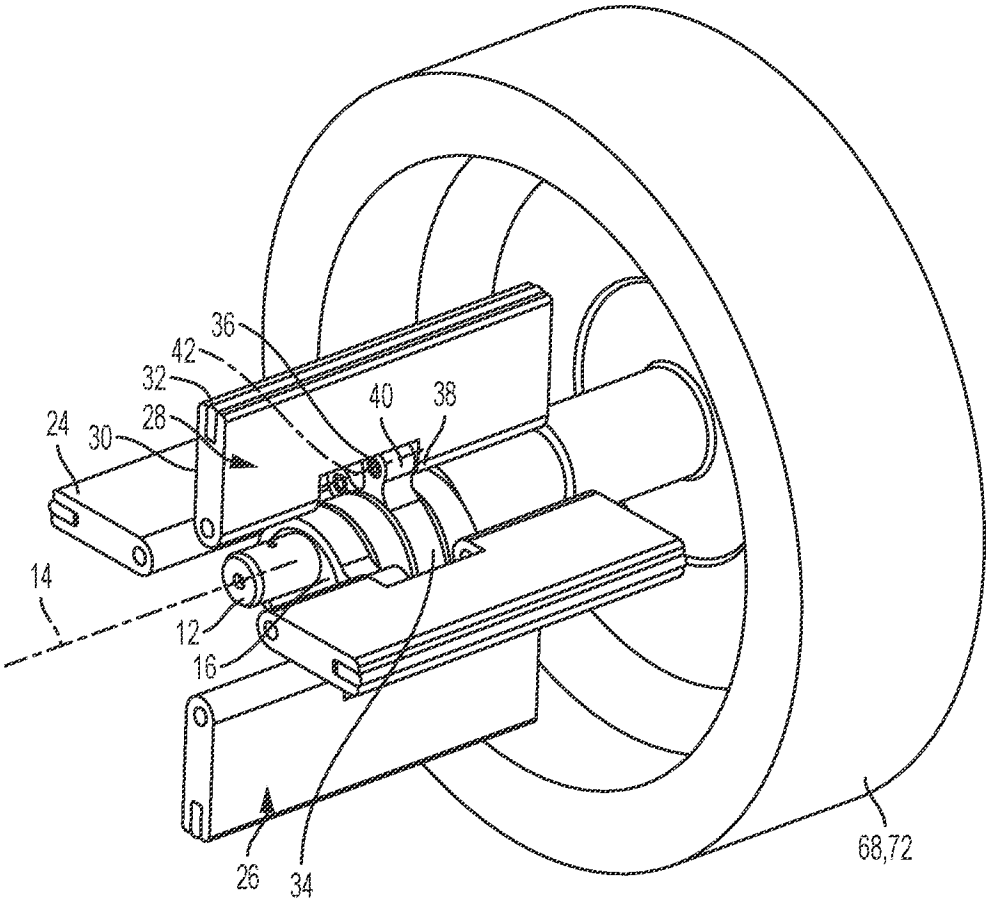
FIG. 3 is an isometric view of an example sub-assembly used in the devices shown in FIGS. 1 and 1A.
Figure 4:
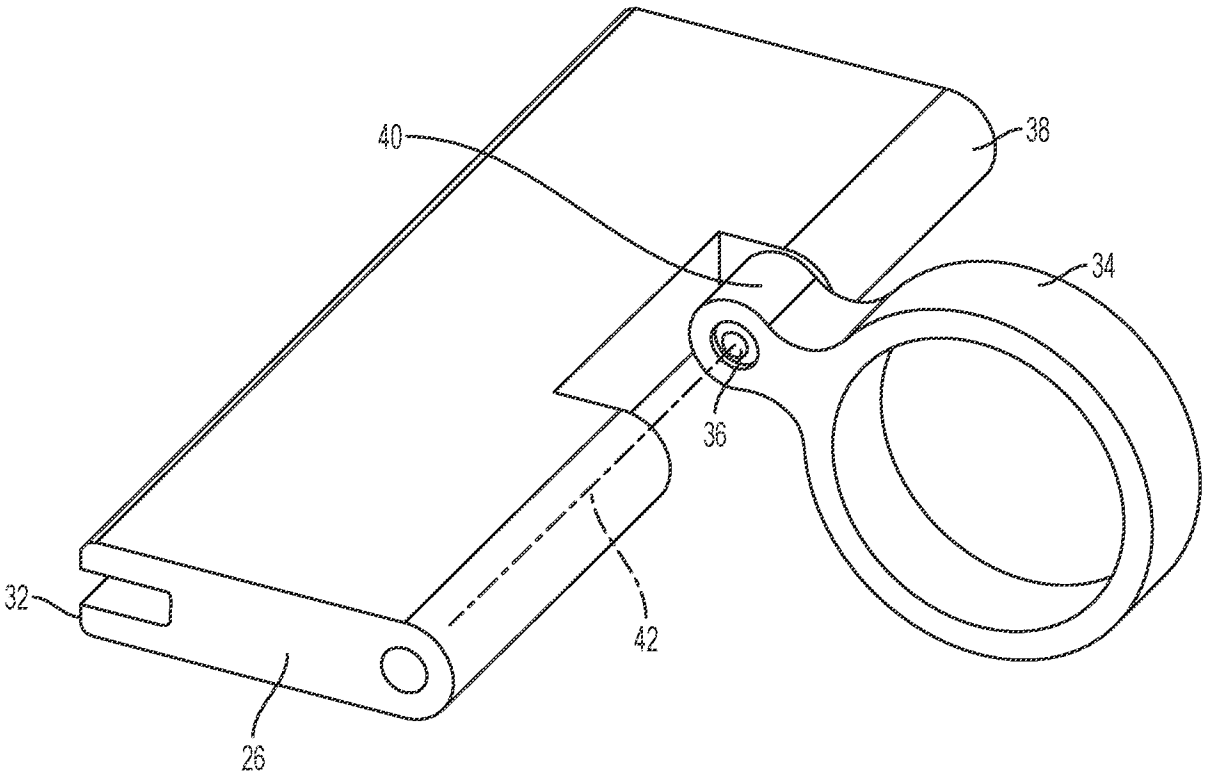
FIG. 4 is an isometric view of a component from the example sub-assembly shown in FIG. 3.

As shown in FIGS. 1 and 3, a plurality of projections 24 are mounted on the cam 16. In this example embodiment the projections comprise vanes 26. Reference hereafter will be to vanes, it being understood that vanes 26 are one example form of projections 24, which may take other forms in other example embodiments of the device 10. Each vane 26 comprises first and second oppositely arranged surfaces 28 and 30 and at least one edge 32. The edges 32 and the surfaces 28 and 30 of vanes 26 are oriented parallel to the shaft axis 14. In the example device shown there are four vanes 26, and each vane is oriented perpendicular to an adjacent vane. Example devices having more or fewer vanes (projections) are also contemplated. The vanes 26 are mounted on cam 16 so as to be rotatable about the cam as well as pivotable relatively thereto. As shown in FIGS. 3 and 4, each vane 26 is attached to a respective ring 34. Rings 34, one for each vane 26, surround cam 16 and are arranged adjacent to one another along the cam. Rings 34 are rotatable relative to cam 16, thereby enabling the vanes 26 mounted thereon to rotate about the cam. Pivoting action of the vanes 26 with respect to the cam 16 is made possible by a respective pin 36 joining each vane 26 to a respective ring 34. Each pin 36 is received by a respective vane lug (projection lug) 38 on each vane 26, and a respective ring lug 40 mounted on each ring. The lugs are arranged so that the pin axis 42 (the axis about which the vane 26 may pivot) is oriented parallel to the shaft axis 14.

Figure 1A:
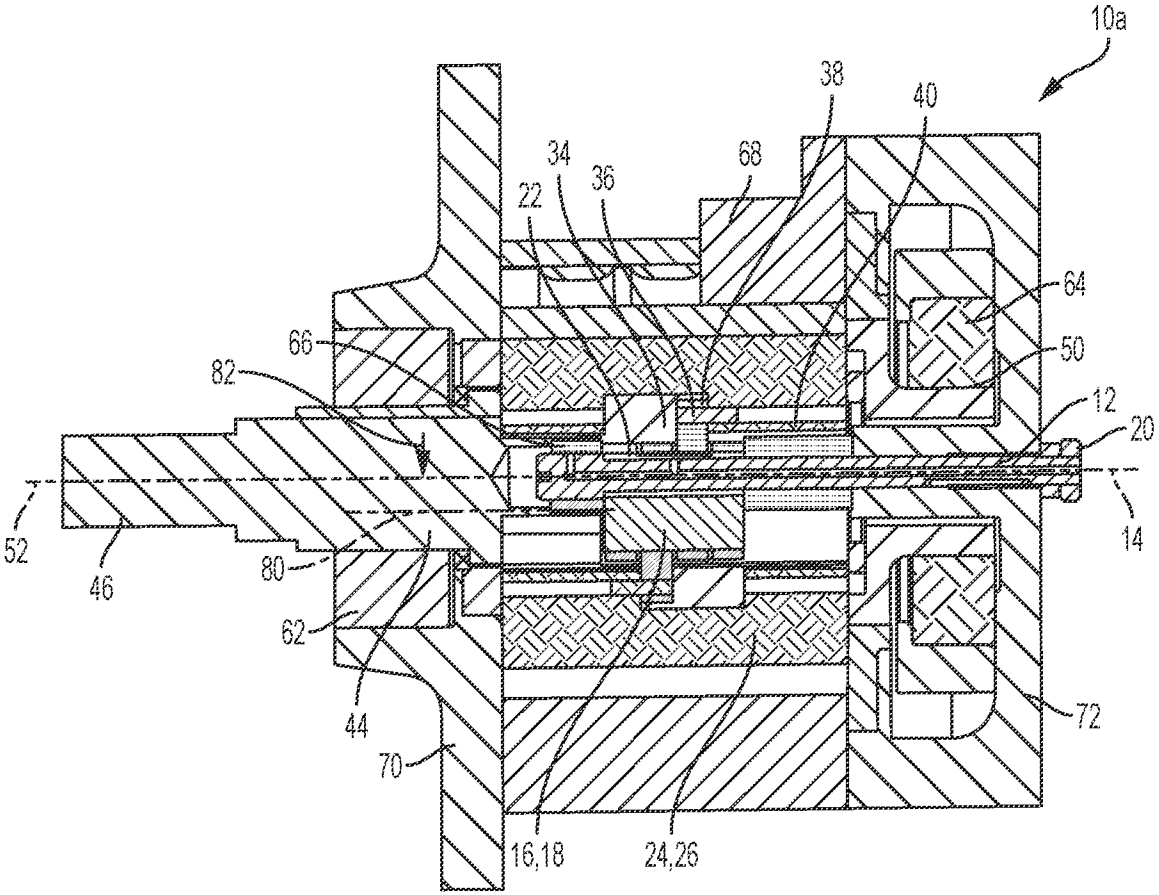
Figure 5:
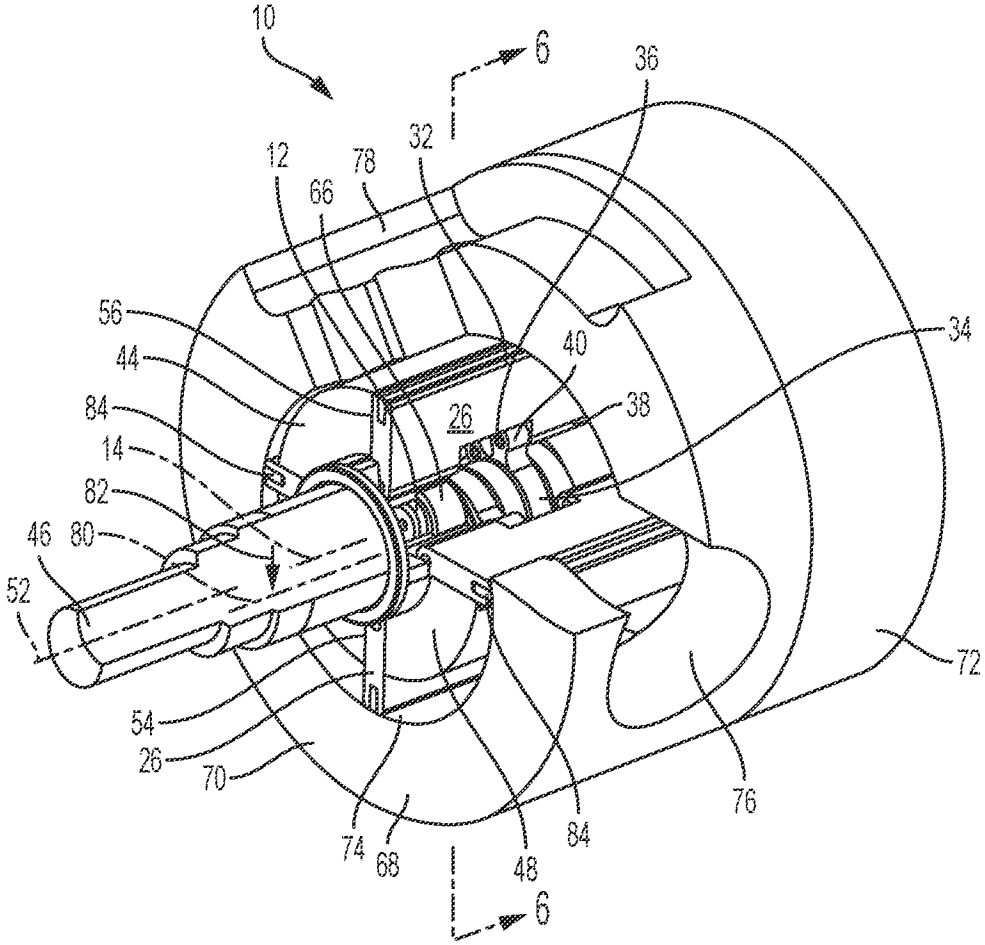
FIG. 5 is an isometric partial sectional view of an example embodiment of the device according to the invention.
Figure 6:
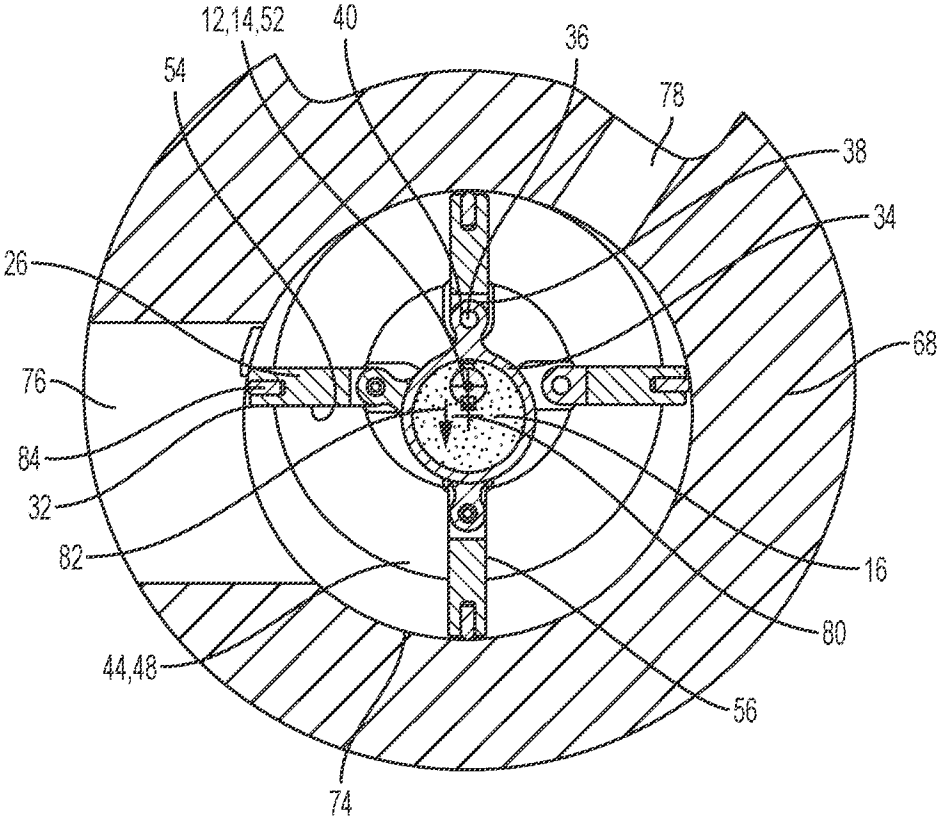
FIG. 6 is a cross sectional view taken at line 6-6 of FIG. 5.

As shown in FIGS. 1 and 5, a rotor 44 surrounds cam 16. In this example embodiment rotor 44 comprises a rotor shaft 46, a rotor body 48 and a hub 50. Rotor body 48 surrounds the cam 16. Rotor shaft 46 is attached to one end of the rotor body 48 and defines a rotor axis of rotation 52 oriented parallel to the shaft axis 14. Hub 50 is attached to an opposite end of the rotor body 48 and is coaxially aligned with the rotor axis of rotation 52. Rotor 44 is rotatable relatively to cam 16, and, as shown in FIGS. 5 and 6, the rotor body 48 has a plurality of openings 54. In the example shown the openings comprise slots 56 oriented parallel to and extending radially outwardly from the rotor axis of rotation 52. Each slot 56 (opening 54) receives a respective vane 26 (projection 24). The slots 56 constrain the motion of the vanes 26 as explained below. As shown in FIG. 1, rotor 44 also comprises first and second end plates 58 and 60. End plates 58 and 60 are attached to rotor 44 in spaced relation to one another, one at the rotor shaft 46 and the other at the rotor hub 50. The vanes 26 are positioned between the end plates 58 and 60. FIG. 1A shows another embodiment of the device 10*a* according to the invention which does not have end plates. Devices 10 having end plates 58 and 60 and devices 10*a* without end plates have different characteristics and are advantageously employed in different applications depending upon factors such as the type of working fluid, the fluid pressure, the rotation speed of the rotor and other parameters. Smooth running of rotor 44 is ensured by a plurality of bearings. As shown in FIG. 1, the rotor shaft 46 is supported on a first or rotor shaft bearing 62, the hub 50 is supported on a second or hub bearing 64, and the rotor body 48 is supported on a body bearing 66 mounted within the rotor 44, concentric with and engaging the shaft 12 proximate to the cam 16.

As shown in FIGS. 1 and 5, the rotor 44 rotates within a housing 68 which surrounds the rotor. Rotor shaft 46 extends from one end 70 of the housing 68, the hub 50 is positioned within the housing at an opposite end 72, and the shaft 12 is also mounted on the opposite end 72 of the housing. The shaft bearing 62 is positioned between the rotor 44 and the housing 68 at the end 70 of the housing, and the hub bearing 64 is positioned between the rotor 44 and the housing 68 at the opposite end 72. The shaft and hub bearings cooperate with the body bearing to ensure a smooth, low friction rotation between the rotor 44 and the housing 68 and the shaft 12 on which cam 16 is mounted.

As shown in FIGS. 5 and 6, the housing 68 comprises a cylindrical surface 74 which faces the rotor 44. Two apertures 76 and 78 extend through the housing 68, including the cylindrical surface 74. Apertures 76 and 78 are oriented transversely to the shaft axis 14 and are angularly offset from one another about a housing axis 80. Cylindrical surface 74 is coaxial with the housing axis 80. Housing axis 80 is offset from the shaft axis 14 in the direction 82 in which the lobe 18 of cam 16 projects (see also FIG. 1). The rotor axis of rotation 52 about which the rotor 44 rotates is coaxial with the shaft axis 14. Cylindrical surface 74 is thus eccentric to the rotor axis of rotation 52. This arrangement of a rotor 44 rotating about a fixed cam 16 on which rotating and pivoting vanes 26 are mounted within slots 56 and within a housing 68 having a cylindrical surface 74 eccentric to the rotor axis of rotation results in the following motion.

As rotor 44 rotates concentrically about shaft axis 14 relatively to cam 16 the rings 34 rotate about the cam eccentrically relatively to the shaft axis 14. Each ring lug 40 thus traverses an eccentric orbit about the shaft axis 14. This eccentric orbit of the ring lugs 40 causes the vanes 26, attached to the rings via pins 36 and vane lugs 38, to reciprocate within in the slots 56 of rotor 44 toward and away from the shaft axis 14 as the rotor 44 rotates because the rotor rotates concentrically about the shaft axis 14, and the vanes 26 rotate eccentrically to the shaft axis. Because the vanes 26 are pivotably attached to the rings 34 via pins 36 the vanes can pivot as they rotate and thus they reciprocate radially toward and away from the shaft axis 14 (and the rotor axis of rotation 52) as they are constrained within respective slots 56 in the rotor body 48. The lobe 18 of cam 16 is angularly positioned about the shaft 12 with respect to the cylindrical surface 74 so as to maintain the edges 32 of vanes 26 proximate to the cylindrical surface during reciprocal motion of the vanes upon relative rotation between the rotor 44 and the shaft 12. For a practical design the phrase "proximate to the cylindrical surface" means that the separation distance between the edges 32 of the vanes 26 and the cylindrical surface 74 during rotation is always from about 0.0005 inches to about 0.25 inches. In designs for which an oil seal is impractical each vane 26 may also comprise a respective seal 84 extending along the edge 32 (see FIGS. 5 and 6). Seal 84 contacts the cylindrical surface 74 continuously upon relative rotation between the rotor 44 and the shaft 12.

Device 10 is versatile and may be used in many different applications. Rotor shaft 46 may be turned, for example, by an electric motor, driving the rotor 44. If aperture 76 is configured as an intake port and aperture 78 as an exhaust port then device 10 could operate as a pump or a compressor. Similarly, if high pressure fluid (liquid or gas) were pumped at pressure into aperture 78 to turn rotor shaft 46 before the fluid exits housing 68 through aperture 76 the device 10 could serve as a hydraulic motor or other fluid expansion device performing work. Additionally, the device 10 is also expected to be adaptable for use in a rotary engine using one of several thermodynamic cycles including, for example the Otto, Atkinson or Brayton cycles.

Devices such as 10 and 10*a* according to the invention represent a class of constrained vane machines wherein the vane's position is controlled by mechanisms other than the housing. It is expected that devices 10 and 10*a* will permit constrained vane machines of simpler design having fewer moving parts which will allow practical machines such as engines, pumps, compressors and hydraulic motors to operate more efficiently, at higher speeds, with less friction and wear than constrained vane machines according to the prior art.

What is claimed is:

1. A device, comprising:

a shaft defining a shaft axis;

a cam mounted on said shaft, said cam having a lobe projecting eccentric to said shaft axis;

a plurality of projections rotatably mounted on said cam, each of said projections being pivotably mounted relative to said cam;

a rotor surrounding said cam and rotatable relatively thereto about said shaft axis, said rotor comprising a plurality of openings, each said opening receiving one of said projections; wherein rotation of said rotor relatively to said cam causes said projections to rotate about said shaft axis while also reciprocating within said openings radially toward and away from said shaft axis.

2. The device according to claim 1, further comprising:

a plurality of rings surrounding said cam, each said projection being pivotably attached to a respective one of said rings, said rings being rotatable relatively to said cam.

3. The device according to claim 2, wherein each said ring comprises a ring lug extending therefrom, each said ring lug receiving a respective pin having a pin axis oriented parallel to said shaft axis, each said projection comprising a projection lug extending therefrom, each said projection lug receiving a respective one of said pins, each of said projections being pivotable relative to one of said rings about one of said pin axes.

4. The device according to claim 1, further comprising a bearing mounted in said rotor concentric to said shaft, said bearing supporting an end of said shaft proximate to said cam.

5. The device according to claim 1, further comprising a housing surrounding said rotor, said rotor extending from one end of said housing, said shaft being mounted on an opposite end of said housing, said rotor being rotatable relatively to said housing.

6. The device according to claim 5, wherein said housing comprises a cylindrical surface facing said rotor, said cylindrical surface being coaxial with a housing axis, said housing axis being offset from said shaft axis.

7. The device according to claim 6, wherein said housing axis is offset from said shaft axis in a direction in which said lobe projects.

8. The device according to claim 6, wherein said lobe is angularly positioned about said shaft with respect to said cylindrical surface so as to maintain an end of each said projection proximate to said cylindrical surface during reciprocal motion of said projections upon relative rotation between said rotor and said shaft.

9. The device according to claim 5, further comprising first and second apertures in said housing, said apertures being oriented transversely to said shaft axis and angularly offset from one another about said cylinder axis.

10. The device according to claim 5, further comprising:

a first bearing positioned at said one end of said housing between said rotor and said housing; and a second bearing positioned at said opposite end of said housing between said rotor and said housing.

11. The device according to claim 6, wherein:

each one of said projections comprises a vane having first and second oppositely arranged surfaces oriented parallel to said shaft axis;

each one of said openings comprises a slot, each one of said slots receiving a respective one of said vanes.

12. The device according to claim 11, further comprising first and second apertures in said housing, said apertures being oriented transversely to said shaft axis and extending through said cylindrical surface, said apertures being angularly offset from one another about said cylinder axis.

13. The device according to claim 11, comprising four of said vanes.

14. The device according to claim 13, wherein each said vane is oriented perpendicularly to an adjacent one of said vanes.

15. The device according to claim 11, wherein said lobe is angularly positioned about said shaft with respect to said cylindrical surface so as to maintain an edge of each said vane proximate to said cylindrical surface during reciprocal motion of said projections upon relative rotation between said rotor and said shaft.

16. The device according to claim 15, wherein each of said vanes comprises a respective seal extending along said edge, said seals contacting said cylindrical surface continuously upon relative rotation between said rotor and said shaft.

17. The device according to claim 11, further comprising first and second end plates attached to said rotor in spaced relation to one another, said vanes being positioned between said end plates.

18. The device according to claim 1, wherein said cam and said shaft are integrally formed.

19. The device according to claim 1, wherein said rotor comprises:

a rotor body surrounding said cam, said openings being positioned in said rotor body;

a rotor shaft attached to one end said rotor body and extending therefrom to define a rotor axis of rotation;

a hub attached to an opposite end of said rotor body, said hub being coaxially aligned with said rotor axis of rotation.

20. The device according to claim 19, wherein said openings comprise slots oriented parallel to said rotor axis of rotation.

21. A device, comprising:

a shaft defining a shaft axis;

a cam mounted on said shaft, said cam having a lobe projecting eccentric to said shaft axis;

a plurality of vanes rotatably mounted on said cam, each of said vanes being pivotably mounted relative to said cam;

a rotor surrounding said cam and rotatable relatively thereto about said shaft axis, said rotor comprising a plurality of slots, each said slot receiving one of said vanes; wherein rotation of said rotor relatively to said cam causes said vanes to rotate about said shaft axis while also reciprocating within said slots radially toward and away from said shaft axis.

22. The device according to claim 21, wherein each of said vanes has first and second oppositely arranged surfaces oriented parallel to said shaft axis.

23. The device according to claim 21, further comprising:

a plurality of rings surrounding said cam, each said vane being pivotably attached to a respective one of said rings, said rings being rotatable relatively to said cam.

24. The device according to claim 23, wherein each said ring comprises a ring lug extending therefrom, each said ring lug receiving a respective pin having a pin axis oriented parallel to said shaft axis, each said vane comprising a vane lug extending therefrom, each said vane lug receiving a respective one of said pins, each of said vanes being pivotable relative to one of said rings about one of said pin axes.

25. The device according to claim 21, further comprising a bearing mounted in said rotor concentric to said shaft, said bearing supporting an end of said shaft proximate to said cam.

26. The device according to claim 21, further comprising a housing surrounding said rotor, said rotor extending from one end of said housing, said shaft being mounted on an opposite end of said housing, said rotor being rotatable relatively to said housing.

27. The device according to claim 26, wherein said housing comprises a cylindrical surface facing said rotor, said cylindrical surface being coaxial with a housing axis, said housing axis being offset from said shaft axis.

28. The device according to claim 27, wherein said housing axis is offset from said shaft axis in a direction in which said lobe projects.

29. The device according to claim 27, wherein said lobe is angularly oriented about said shaft with respect to said cylindrical surface so as to maintain an edge of each said vane proximate to said cylindrical surface during reciprocal motion of said vanes upon relative rotation between said rotor and said shaft.

30. The device according to claim 29, wherein each of said vanes comprises a respective seal extending along said edge, said seals contacting said cylindrical surface continuously upon relative rotation between said rotor and said shaft.

31. The device according to claim 26, further comprising first and second apertures in said housing, said apertures being oriented transversely to said shaft axis and extending through said cylindrical surface, said apertures being angularly offset from one another about said cylinder axis.

32. The device according to claim 26, further comprising:

a first bearing positioned at said one end of said housing between said rotor and said housing; and a second bearing positioned at said opposite end of said housing between said rotor and said housing.

33. The device according to claim 21, comprising four of said vanes.

34. The device according to claim 33, wherein each said vane is oriented perpendicularly to an adjacent one of said vanes.

35. The device according to claim 21, further comprising first and second end plates attached to said rotor in spaced relation to one another, said vanes being positioned between said end plates.

36. The device according to claim 21, wherein said cam and said shaft are integrally formed.

37. The device according to claim 21, wherein said rotor comprises:

a rotor body surrounding said cam, said slots being positioned in said rotor body;

a rotor shaft attached to one end said rotor body and extending therefrom to define a rotor axis of rotation;

a hub attached to an opposite end of said rotor body, said hub being coaxially aligned with said rotor axis of rotation.

38. The device according to claim 37, wherein said slots are oriented parallel to said rotor axis of rotation.

* * * * *